US008291990B1

(12) United States Patent
Mohr

(10) Patent No.: US 8,291,990 B1
(45) **Date of Patent: *Oct. 23, 2012**

(54) FIRE FIGHTING SYSTEM

(75) Inventor: John A. Mohr, Camarillo, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 436 days.

This patent is subject to a terminal disclaimer.

(21) Appl. No.: 12/550,684

(22) Filed: Aug. 31, 2009

Related U.S. Application Data

(63) Continuation-in-part of application No. 11/821,474, filed on Jun. 18, 2007, now Pat. No. 7,766,090, which is a continuation-in-part of application No. 11/094,547, filed on Mar. 22, 2005, now abandoned.

(51) Int. Cl.
*A62C 35/00* (2006.01)

(52) U.S. Cl. ..... 169/12; 169/13; 169/52; 169/67; 169/70

(58) Field of Classification Search ..... 169/12, 169/52, 70, 13, 67
See application file for complete search history.

(56) References Cited

U.S. PATENT DOCUMENTS

| | | | | |
|---|---|---|---|---|
| 5,046,564 | A * | 9/1991 | Poulsen | 169/47 |
| 7,766,090 | B2 * | 8/2010 | Mohr | 169/12 |
| 2004/0055765 | A1 * | 3/2004 | Dillman | 169/47 |

* cited by examiner

*Primary Examiner* — Dinh Q Nguyen
(74) *Attorney, Agent, or Firm* — Christopher L. Blackburn; David S. Kalmbaugh

(57) ABSTRACT

A fire fighting system for fighting forest and brush fires under dry, hot and windy conditions which includes a jet engine for generating a high speed air stream, a water source for supplying water to a cooling system which lowers the water temperature to between forty and fifty degrees Fahrenheit, a nozzle for injecting cold water into the air steam and a filter which provides very fine particles of cold water within the stream. The stream of cold water is directed to a forest or brush fire dropping the temperature of the fire which eventually extinguishes the fire.

20 Claims, 9 Drawing Sheets

FIRE FIGHTING SYSTEM

This application is a continuation in part of U.S. patent application Ser. No. 11/821,474, filed Jun. 18, 2007 now U.S. Pat. No. 7,766,090, which is a continuation in part of U.S. patent application Ser. No. 11/094,547, filed Mar. 22, 2005, now abandoned.

BACKGROUND OF THE INVENTION

1. Field of the Invention

The present invention relates generally to fire fighting systems and equipment. More specifically, the present invention relates to a jet engine blower type fire fighting system which generates high velocity liquid cooled air streams at a constant temperature and velocity that are very useful in fighting forest and other types of fire.

2. Description of the Prior Art

Forest and grass land fires in the western states including California are a constant concern because of the lack of moisture, the extremely short raining season, the high winds and the long hot summers. Starting in mid summer and continuing through the fall the chance of serious fires is high since spring growth caused by winter rain is dry and there is virtually no precipitation during the summer months.

During the summer and fall, when a scrub brush or forest fire starts it will generally spread rapidly and is extremely difficult or impossible to control. The result can be a loss of forest, houses and buildings surrounding the area where the fire is burning. During a typical fire season in Southern California damages to property can cost as high as a billion dollars or more.

When the rain finally arrives in December and January the ground is often barren of vegetation which results in erosion of the soil and mud slides. This leads to additional property loss since homes and commercial building can be on unstable soil especially on hillsides and in canyons. There may also be homes severely damaged when cliffs erode sending thousand of cubic feet of mud into occupied homes.

Conventional methods for fighting fires under dry and windy conditions include the use fire fighting vehicles for directing high pressure water or fire retardants at the fire. Aircraft with water scoops have been used to fight forest and brush fires under dry and windy conditions. Fire breaks are another technique used by fire fighters to fight forest and brush fires under dry and windy conditions.

Water is directed at the fire from a nozzle which results in the fire being controlled by fire fighters in only one extremely small area. A fast moving fire will often jump a fire break. Fire retardants are not safe to use in residential areas because they contain environmentally unsafe chemicals which are harmful to animals and humans. Aircraft with water scoops are very limited in the capabilities in that they can not fly in high winds and take a significant amount of time to fill their scoops and return to the fire.

Accordingly, there is a need for a fire fighting apparatus which is effective and efficient at fighting forest and brush fires under dry and winding conditions.

SUMMARY OF THE INVENTION

The present invention overcomes some of the difficulties of the past including those mentioned above in that it comprises a relatively simple yet highly effective fire fighting system for use in fighting forest and brush fires under hot, dry and windy conditions.

The fire fighting system of the present invention includes a jet engine for generating an extremely high velocity air stream, e.g. in the range of 100 to 400 mph. Water from a reservoir or other source is supplied to a refrigeration unit which lowers the water temperature to between forty and fifty degrees Fahrenheit. The cold water is then pressurized and pumped into the resultant air stream resulting in cold water particles in the sir stream. A filter/screen mesh is next used to generate very fine particles of water in the order of several microns, e.g. 1-40 microns.

The particle size cold water droplets are driven into the atmosphere at the fire's edge dropping the temperature considerably at the fire's edge which creates a barrier against the fire. This, in turn, prevents the fire from spreading and the resulting heat loss will eventually extinguish or put out the fire.

The jet engine is generally mounted on a mobile platform which is towed to the fire. When the fire is in a residential or commercial area fire hydrants supply the water used to fight the fire.

DETAILED DESCRIPTION OF THE PREFERRED EMBODIMENTS

Figure 1:
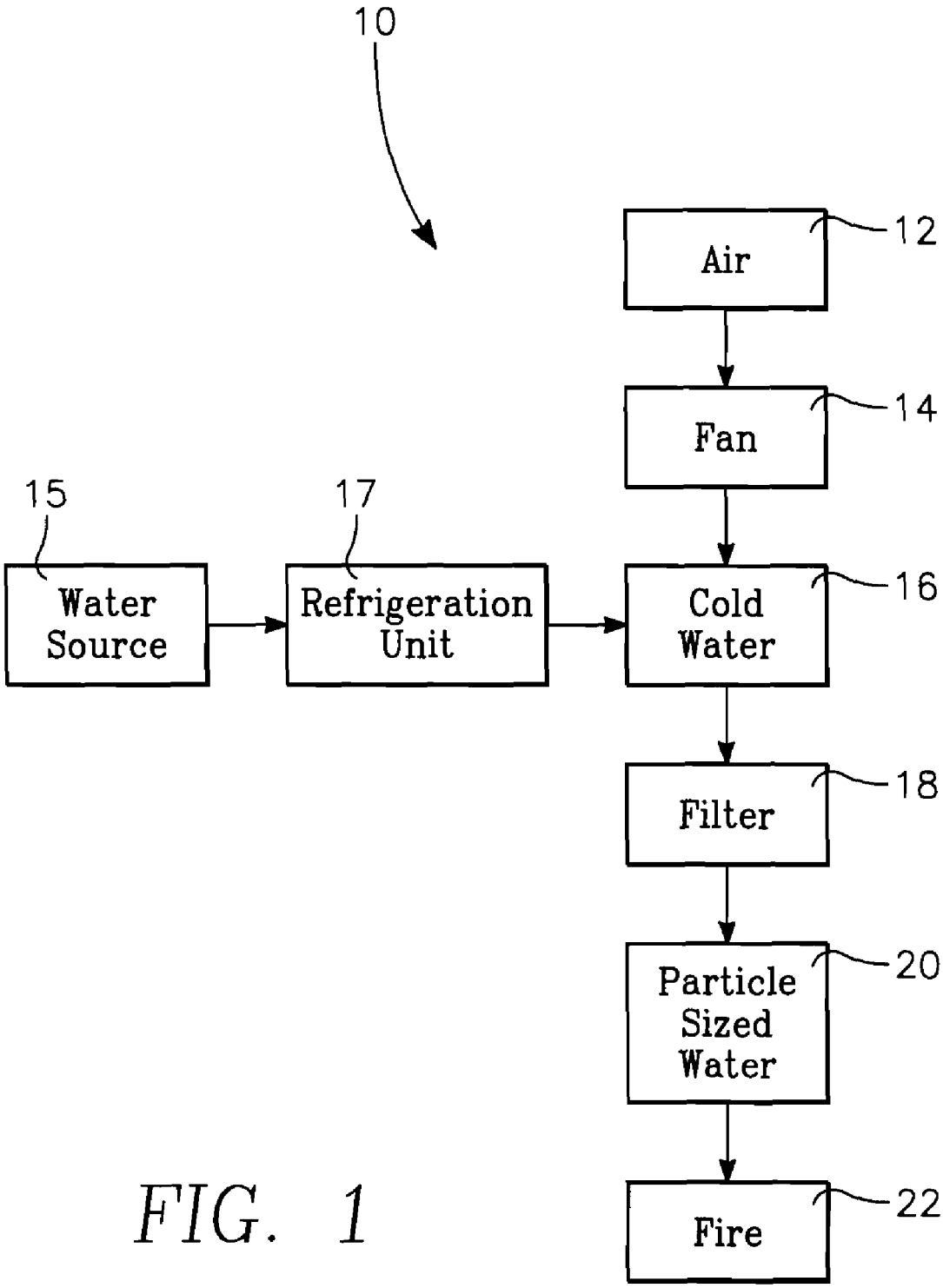
FIG. 1 is a block diagram which depicts the weather adjustment system used to fight forest and brush fires under dry and windy conditions.

Referring to FIG. 1, there is shown a block diagram of a fire fighting system 10 which is used to fight forest and brush fires under hot, winding and dry conditions. A blower/fan 14 moves air 12 from the atmosphere through the fan housing exiting the housing at extremely high speeds, e.g. between 100 and 400 mph. Cold water 16 is then pumped into the resultant air flow generating particles of water. The temperature range of the water is generally in the range of 40 to 50 degrees Fahrenheit. A filter/screen mesh 18 may be used to generate very fine particles of water in the order of several microns, e.g. 1-40 microns.

Particle size cold water droplets 20 are driven into the atmosphere 22 which drops the temperature considerably at the edge of the fire creating a barrier against the fire. This, in turn, prevents the fire from spreading and the resulting heat loss will extinguish or put out the fire.

The fan 14 may be any conventional centrifugal machine which draws air into its casing using a rotating impeller or fan blade assembly. The fan blade assembly is driven by an electric motor which may be either an AC machine or a DC machine. Air flowing through the casing is accelerated exiting the casing at high speeds and medium to high pressures. A wind tunnel type fan or blower is typical of the fan used in the preferred embodiments of the invention.

The water source 15 for supplying cold water can be any of a number of sources such a fire hydrant in an industrial or commercial area. Other sources of cold water include a pump which is used to pump cold water from a lake or a reservoir, a separate vehicle having a water tank and a fire fighting vehicle which carries a water tank. A cooling system/refrigeration unit 17 insures that the temperature of the cold water is maintained at the desired temperature level of 40 to 50 degrees Fahrenheit.

Figure 2:
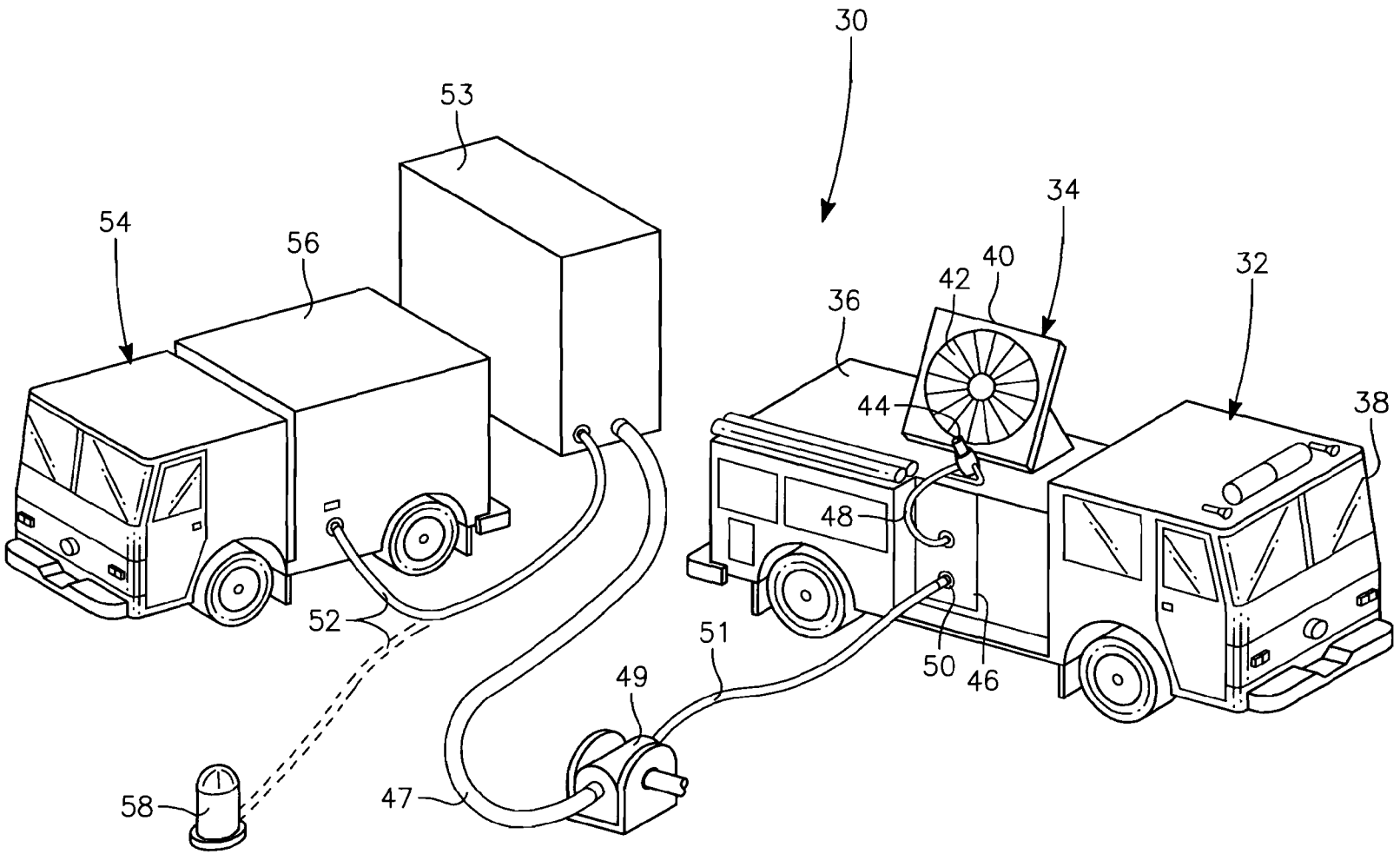
FIG. 2 illustrates the weather adjustment system of FIG. 1 which has the fan/blower mounted on a fire fighting vehicle.
Figure 3:
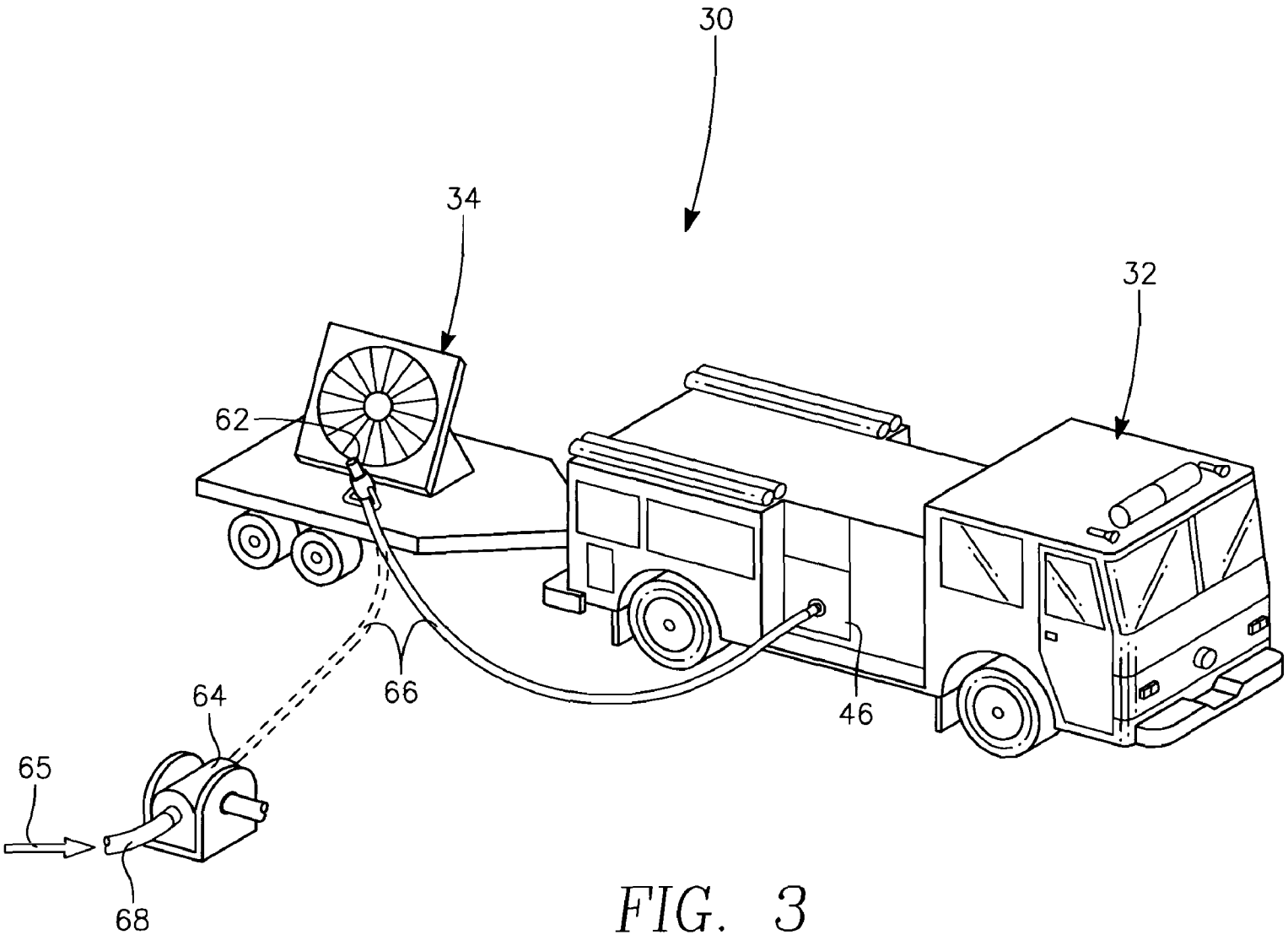
FIG. 3 illustrates the weather adjustment system of FIG. 1 which has the fan/blower mounted on a trailer which is towed by the fire fighting vehicle.
Figure 4:
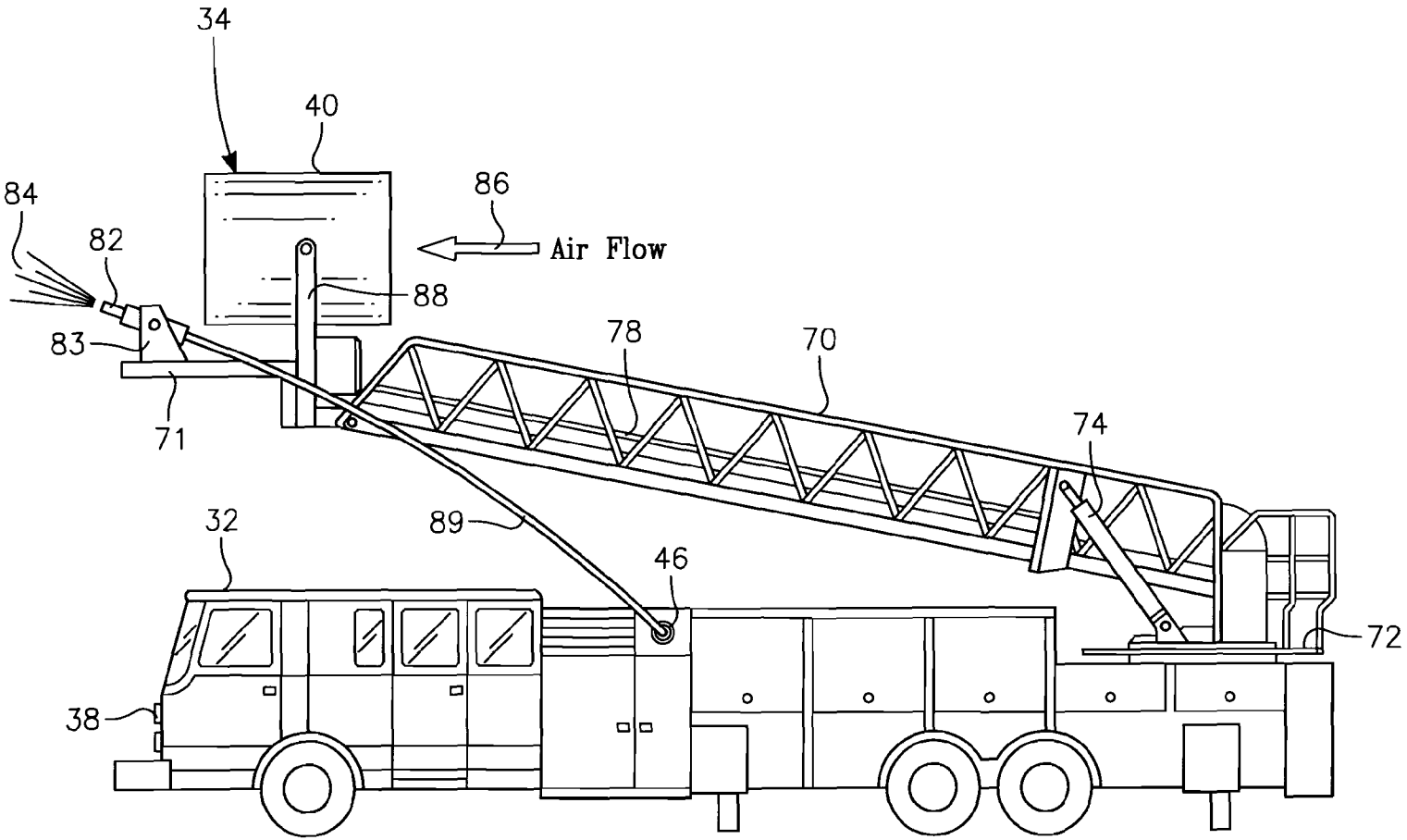
FIG. 4 illustrates the weather adjustment system of FIG. 1 which has the fan/blower mounted on a fire fighting vehicle boom.

Referring to FIGS. 2, 3 and 4, there are shown preferred embodiments of the present invention. FIG. 2 illustrates the fire fighting system 30 for fighting fires which comprises a fire fighting vehicle 32 and a fan/blower 34 mounted on the upper rear portion 36 of the fire fighting vehicle 32 behind the cab 38 of vehicle 32. Fan/blower 34 includes a fan housing 40 and a fan blade assembly 42 comprising a plurality of individual fan blades. A fan motor is energized to rotate fan blades 42.

Mounted in front of the fan blade assembly 42 on fire fighting vehicle 32 is a nozzle 44. Nozzle 44 is connected to the water storage tank 46 on fire fighting vehicle 32 by a hose 48. Since the water storage tank 46 on fire fighting vehicle 32 generally has limited storage capacity a water inlet valve 50 is provided for the storage tank 46. Water storage tank 56 generally holds several thousand gallons of water to re-supply the water storage tank 46 on fire fighting vehicle 32.

To lower the temperature of water from storage tank 56 to the desired temperature of 40-50 degrees Fahrenheit a cooling system 53 is included in system 30. Hose 52 connects storage tank 52 to cooling system 53. Cooling system 53 is connected to the water storage tank 46 on fire fighting vehicle 32 by a hose 47, pump 49 and a hose 51. Pump 49 transfers the temperature controlled water under pressure from cooling system 53 through hose 47 and hose 51 to the water storage tank 46 on fire fighting vehicle 32. This insures that water from nozzle 44 is within the desire temperature range of 40 to 50 degrees Fahrenheit.

An alternate source of water is a fire hydrant 58 when the fire is near an industrial, commercial or residential area. The fire hydrant 58 is connected the refrigeration unit/cooling system 53 by hose 52 which is now shown in phantom.

FIG. 3 illustrates the fan/blower 34 being towed being towed by the fire fighting vehicle 32 to the fire. The fan/blower 34 is mounted on a mobile platform 60 along with a nozzle 62 which is positioned in front the fan/blower 34. Water for the nozzle is supplied by storage tank 46 on vehicle 32, fire hydrant 58 or a pump 64. A hose 66 is used to connect storage tank 46, fire hydrant 58 or the discharge port of pump 64 to nozzle 62. A hose 68 connected to the inlet port of pump 64 is used by pump 64 to draw water from a source such as a lake, stream or reservoir through the refrigeration unit 53 (FIG. 3). Arrow 65 indicates the direction cold water is flowing from the refrigeration unit 53 through pump 64 and hose 66 to nozzle 62. Hose 66 is shown in phantom when hose 66 is used to connect the discharge port of pump 62 to nozzle 62.

FIG. 4 illustrates the fan/blower 34 mounted on a platform 71 at the upper/head end of a boom 70. The lower/tail end of boom 70 is connected to a platform 72 which rotates three hundred sixty degrees allowing the user of fire fighting vehicle 32 to rotate boom 70 and fan 34 to any desired positioned. A pair of hydraulic jacks 74 attached to platform 72 and boom 70 raise and lower boom 70, platform 71 and fan/blower 34. The boom 70 also has a ladder 78 which extends outward from the lower portion of the boom 70 and retracts into the lower portion of the boom 70. A nozzle 82 mounted on platform 71 in front of fan/blower 34 directs a stream of cold water 84 at the fire. Strong winds generated by fan/blower 34 cause water particles to form within the stream of cold water 84 which when directed at a fire provide a barrier against the fire. The resultant temperature drop from the particles in the stream of cold water 84 will eventually extinguish the fire.

The fan housing 40 is rotatably mounted on a U-shaped support bracket 88 which allows for rotation of the fan housing 40 from a horizontal position as shown in FIG. 4 approximately ninety degrees to a vertical position. In a like manner nozzle 82 is rotatably mounted on nozzle support bracket 83 attached to platform 71. Thus, a user can change the direction of flow of the stream of cold water 84 by simultaneously rotating nozzle 82 and fan housing 40. The rotation of housing 40 and nozzle 82 is either by a manual adjustment from platform 71 or from controls located in the cab 38 of fire fighting vehicle 32.

A retractable hose 89 connects nozzle 82 to the water tank 46 located on board fire fighting vehicle 32. Alternate sources of cold water such as pump 64, fire hydrant 58 and water supply vehicle 54 may be used to supply cold water to nozzle 82.

Figure 6:
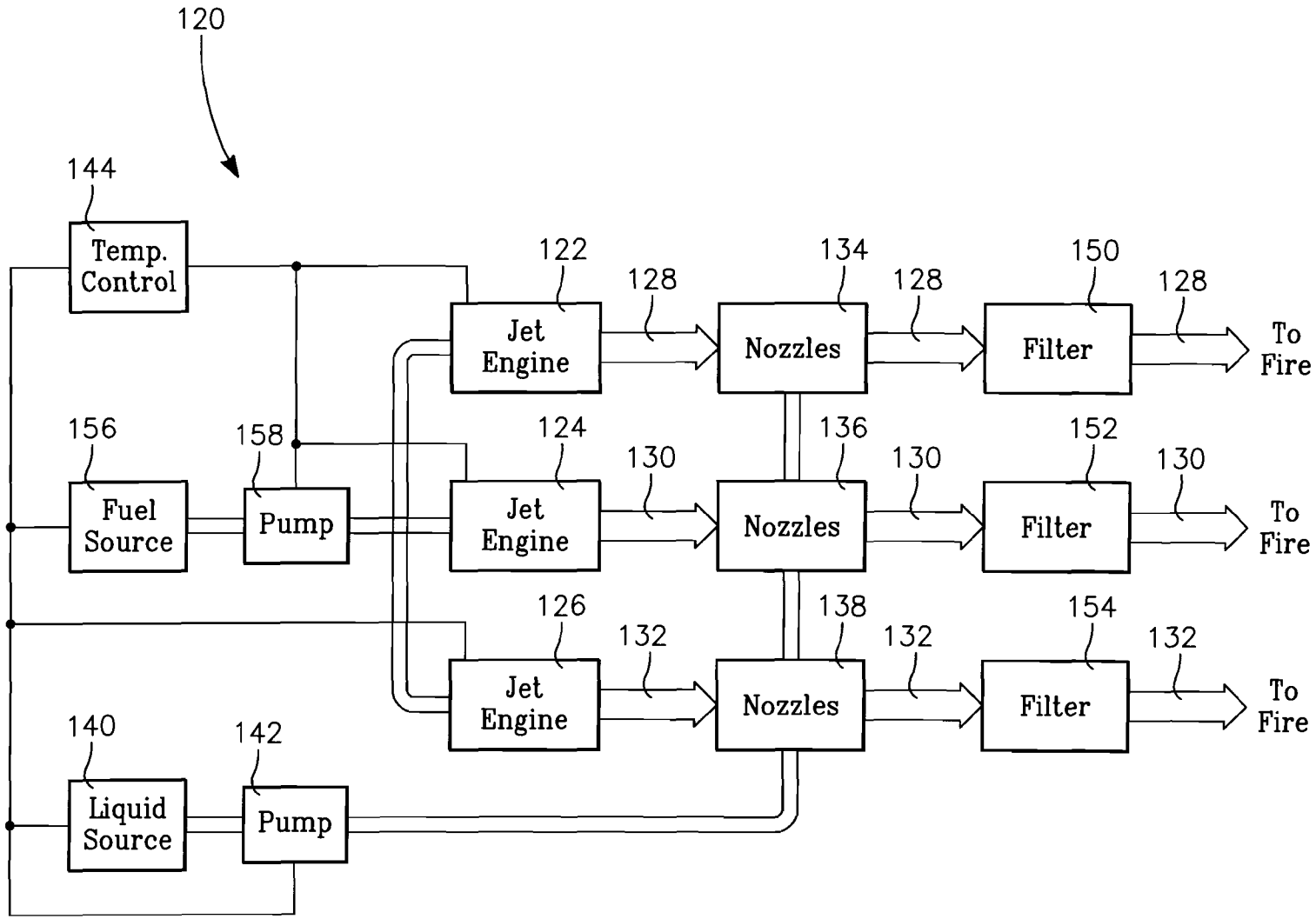
FIG. 6 is a block diagram which illustrates an alternate embodiment of a fire fighting system which utilizes jet engines and a temperature controlled liquid for fighting forest and brush fires.

Referring to FIG. 6, there is shown a block diagram of an embodiment of fire fighting system 120 which utilizes jet engines 122, 124 and 126 to generate high velocity wind streams of air 128, 130 and 132. A constant temperature liquid is injected into each wind stream 128, 130 and 132 by three groups of nozzles 134, 136 and 138.

The first group of nozzles 134 for injecting the temperature controlled liquid into air stream 128 are positioned downstream from jet engine 122 along the air flow path for air stream 128. Similarly, the second group of nozzles 136 for injecting the temperature controlled liquid into air stream 130 are positioned downstream from jet engine 124 along the air flow path for air stream 130. In a like manner, the third group of nozzles 138 for injecting the temperature controlled liquid into air stream 132 are positioned downstream from jet engine 126 along the air flow path for air stream 132.

Figure 5:
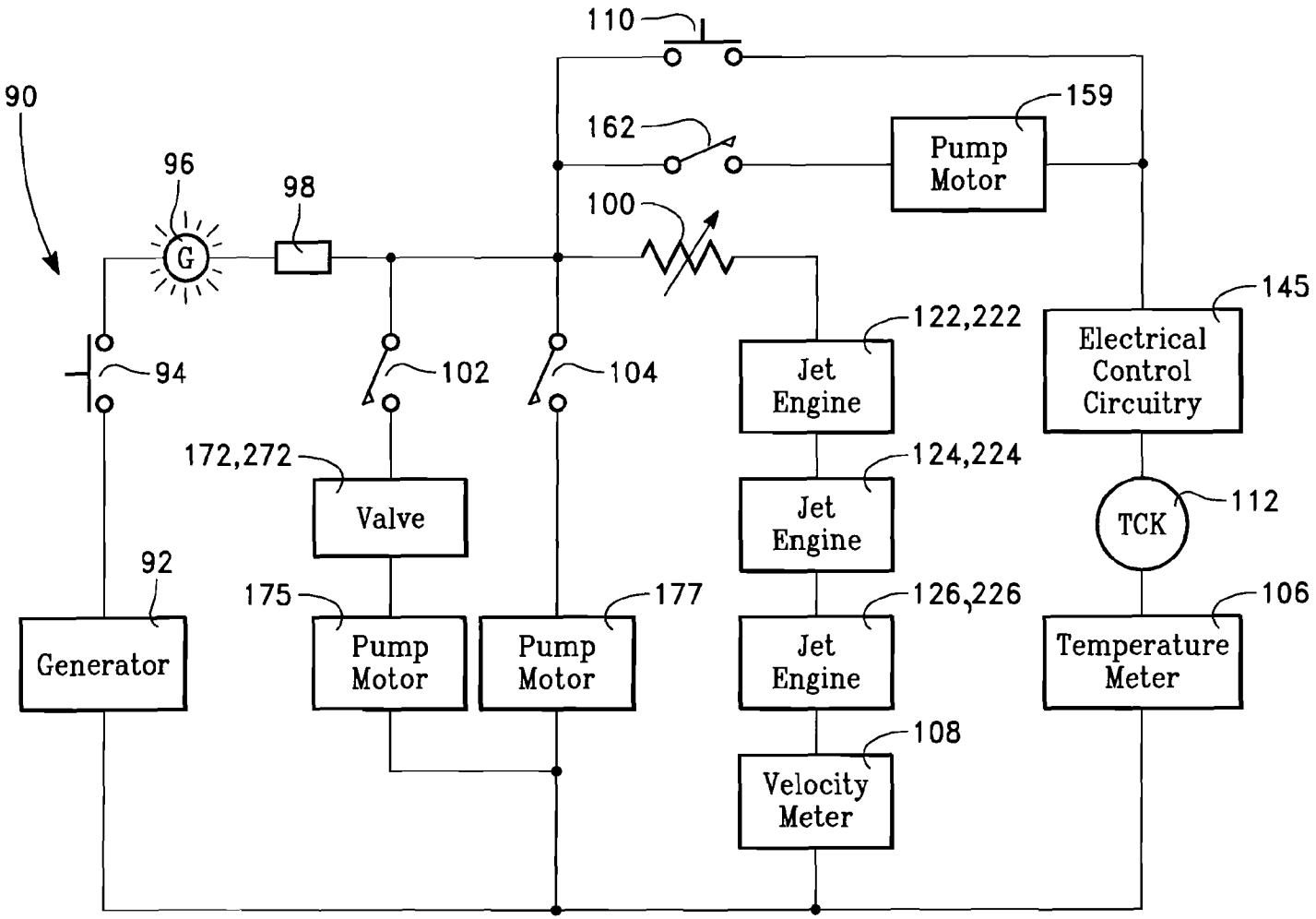
FIG. 5 illustrates an electrical circuit for supply power to the various embodiments of the fire fighting system comprising the present invention.
Figure 7:
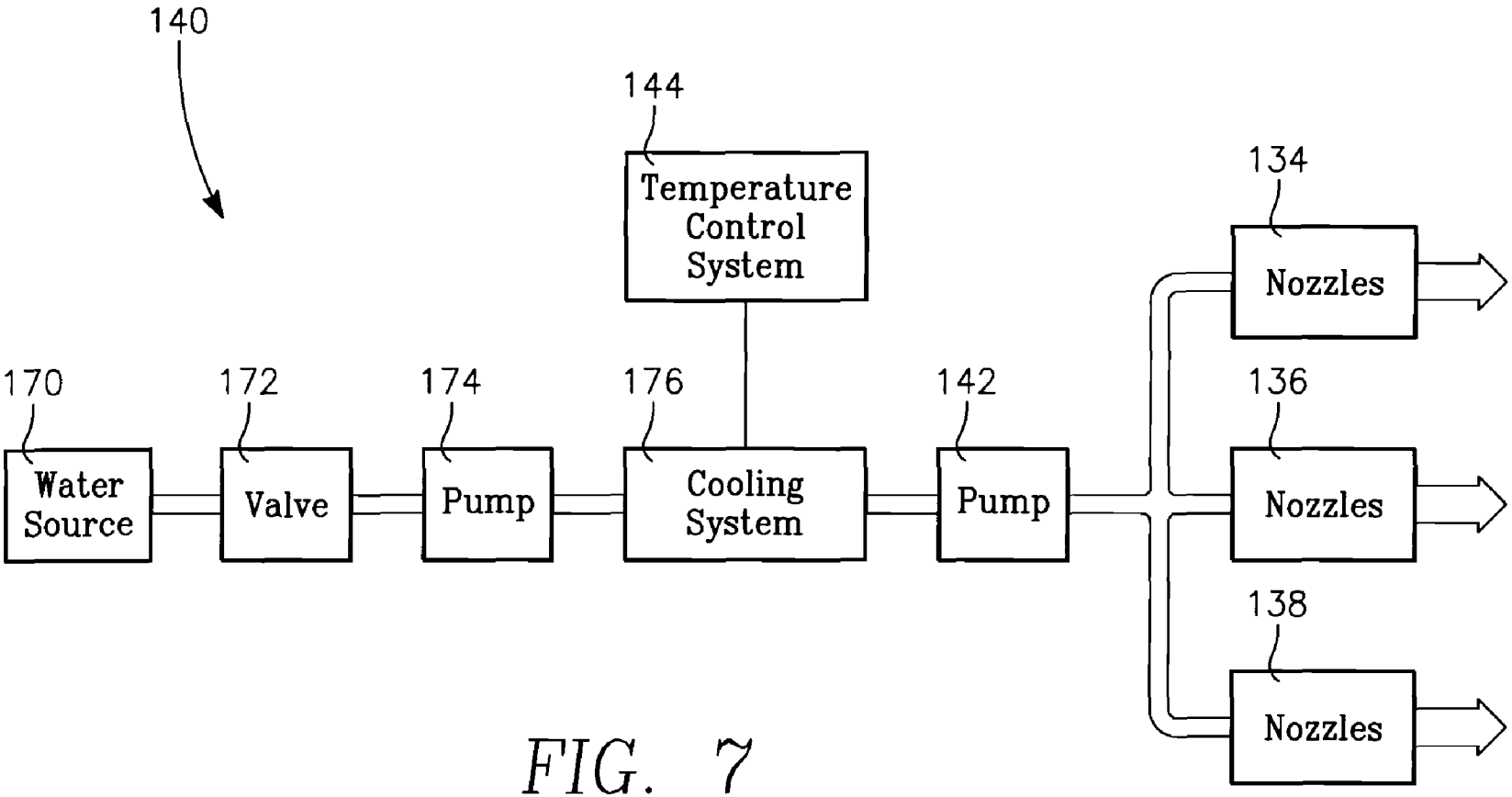
FIG. 7 is a block diagram of the system for maintaining the temperature controlled liquid at a constant temperature.

Referring to FIGS. 5, 6 and 7, the fire suppressant liquid from liquid source 140 is supplied to nozzles 134, 136 and 138 by a pump 142. The fire suppressant liquid, which is usually water that is generally lowered and then maintained at a temperature in the range of 40 to 50 degrees Fahrenheit. The water source 170 for supplying water can be any of a number of sources such a fire hydrant in an industrial, residential or commercial area. Other sources of cold water include a lake or a reservoir, a separate vehicle having a water tank and a fire fighting vehicle which carries a water tank.

A pump 174 transfers water under pressure from water source 170 through a shut off valve 172 to a cooling system 176 which lowers the water temperature from about 70-80 degrees Fahrenheit (ambient temperature) to the desired temperature range of 40 to 50 degrees Fahrenheit. The cooler water temperature of 40 to 50 degrees Fahrenheit provides an advantage to fire fighters trying to extinguish a wild fire or a forest fire in that it significantly lowers the temperature around the fire, thereby making it easier for fire fighters to control and then extinguish the fire.

The cooling system 176 may be a refrigeration unit which has its temperature controlled by a temperature control system 144. Temperature control system 144 includes electrical temperature control circuitry 145 (FIG. 5) and a temperature control knob 112 (FIG. 5) which allows a user to set the desired temperature for fire suppressant liquid. Temperature control system 144 also allows a user to monitor the temperature of the fire suppressant liquid to insure that the temperature of the fire suppressant liquid is optimal for extinguishing the fire. A temperature meter 106 (FIG. 5) allows the user to monitor the temperature of the fire suppressant liquid which is presented to the user in degrees Fahrenheit.

Referring to FIGS. 5 and 7, circuit 90 allows a user to activate and de-activate pump 174 and open and close shut off valve 172. The user must open shut off valve 172 prior to activating pump 174 and withdrawing water from water source 170.

After the temperature is lowered to the desired temperature by cooling system 176, the user activates pump 142 from electrical control device/temperature control system 144 to transfer the cooled water, which now has temperature of 40-50 degrees Fahrenheit, from cooling system 176 to nozzles 134, 136 and 138. Pump 142 pressurizes the cooled water which allows nozzles 134 to inject cooled water into air stream 128, nozzles 136 to inject cooled water into air stream 130, and nozzles 138 to inject cooled water into air stream 130.

Positioned downstream from nozzles 134 along the air flow path for air stream 128 is a filter 150 which reduces the cooled water injected into air stream 128 to water droplets having a particle size 1-40 microns. Similarly, there is positioned along the air flow path for air stream 130 a filter 152 which reduces the cooled water injected into air stream 130 to water droplets having a particle size 1-40 microns. In a like manner, there is positioned along the air flow path for air stream 132 a filter 154 which reduces the cooled water injected into air stream 132 to water droplets having a particle size 1-40 microns. The air stream provided at the outlet side of each filter 150, 152 and 154 now has as a component thereof a temperature controlled watering used in fighting forest and brush fires.

The velocities generated by jet engines 122, 124 and 126 for air streams 128, 130 and 132 are very high often approaching 100-400 mph. The high speed air streams 126, 128 and 130 which include the temperature controlled watering mist a very effective at fighting forest and brush fires. The air streams 126, 128 and 130 with cooled water mist significantly lower the temperature in targeted area of the fire extinguishing the fire.

Temperatures in the targeted area of the fire drop from normal or ambient high of 75 to 100 degrees Fahrenheit to a cool 40-50 degrees Fahrenheit adding moisture to the atmosphere. In hot, dry and dusty western states during the summer and fall, it is very important to cool the temperature and substantially increase the humidity in the atmosphere.

Referring to FIGS. 5, 6 and 7, there is shown an electrical circuit 90 for supplying electrical current to jet engines 122, 124, and 126. This activates jet engines 122, 124 and 126 which generates air flow at very high velocities flow rates in the two to four hundred miles/hour range to assist in fighting fires in extremely hot, windy and dry conditions. Electrical circuit 90, which is generally located on board vehicle 32, includes a generator 92 for supplying electrical current to jet engines 122, 124 and 126. Generator 92 may be either a direct current source or an alternating current source.

Connected to generator 92 is a normally open push button switch 94 which when closed energizes engines 122, 124 and 126. A green light 96 connected in series to push button switch 94 provides an indication that jet engines 122, 124 and 126 are operational when light 96 is illuminated. A fuze 98 connected to green light 96 provides overload protection against excess current flow to jet engines 122, 124 and 126 which could damage fan motors. Speed control for jet engines is provided by a variable resistor 100 which controls current flow to jet engines 122, 124 and 126. By increasing current flow to jet engines 122, 124 and 126 their speed in revolutions per minute is increased and a reduction in current flow to jet engines 122, 124 and 126 results in a reduction in their speed.

Circuit 90 includes pump motor 175 for pump 174 and pump 177 for pump 142. Closing switch 102 opens normally closed valve 172 and activates pump motor 175. Activating pump motor 175 withdraws water from water source 140 under pressure which is supplied to cooling system 176. Closing push button 110 supplies electrical current to electrical circuitry 145. Electrical control circuitry 145 activates the cooling elements for cooling system 10 which reduces the temperature of the fire suppressant liquid/water from about 70 degrees Fahrenheit to about 40-50 degrees Fahrenheit.

Circuit 90 also has a temperature control knob 112 for adjusting the temperature for controlling electrical control circuitry 145. By adjusting the temperature control knob 112, the user can adjust the temperature at which the liquid is cooled to a desired temperature. This temperature may be 42 degrees Fahrenheit, 45 degrees Fahrenheit or 50 degrees Fahrenheit.

Temperature meter 106 within circuit 90 allow a user monitors the temperature of the fire suppressant liquid within cooling system 176. When the temperature is at the desired temperature, normally open switch 104 closes which activates the pump motor 177 for pump 142. When pump 142 is activated the fire suppressant liquid is withdrawn from cooling system 176 and supplied to nozzles 134, 136 and 138.

There is also a meter 108 used to measure the speed of jet engines 122, 124 and 126 by measuring current flow through circuit 90. This, in turn, provides an indication of wind speed generated by fans 102, 104 and 106.

The push button switch 94 and 110, switches 102 and 104, variable resistor 100, green light 96, temperature control knob 112 and meters 108 are normally located in the cab 38 of fire fighting vehicle 32, providing the user of fire fighting vehicle easy access to the controls and monitoring devices of fire fighting system 10.

A pump 158 is included in system 120 to transfer fuel from fuel source 156 to each jet engine 122, 124 and 126. The pump motor 159 for pump 158 is activated by closing switch 162. This results in the fuel being transferred under pressure from fuel source 156 to each of the jet engines 122, 124 and 126.

The generator 92 may be replaced with a diesel powered generator for generating the electrical current required to activate jet engines 122, 124 and 126. The use of a diesel powered generator is preferred in remote areas where conventional sources of power are not readily available. Other sources of electrical power for jet engines 122, 124 and 126 include solar power cells, wind driven electrical generators, and tapping electrical transmission lines. The electrical power source selected to power the fan motors depends upon the power requirements, i.e. how many fan powers are being driven by the power source; weather conditions; ability to access conventional sources of electrical power such as transmission lines and the location of the fire, i.e. is the fire in a remote location where access to conventional is not possible.

The circuit 90 illustrated in FIG. 5 can be used to operate the electrical fan motors which rotate fan blades 42. The fan motors must have sufficient horsepower and rotational speed to generate wind speeds which are adequate to effectively fight forest fires in dry and winding conditions. Aircraft motors used to drive large fan blades would replace the jet engines 122, 124 and 126 illustrated in FIG. 5.

Figure 8A:
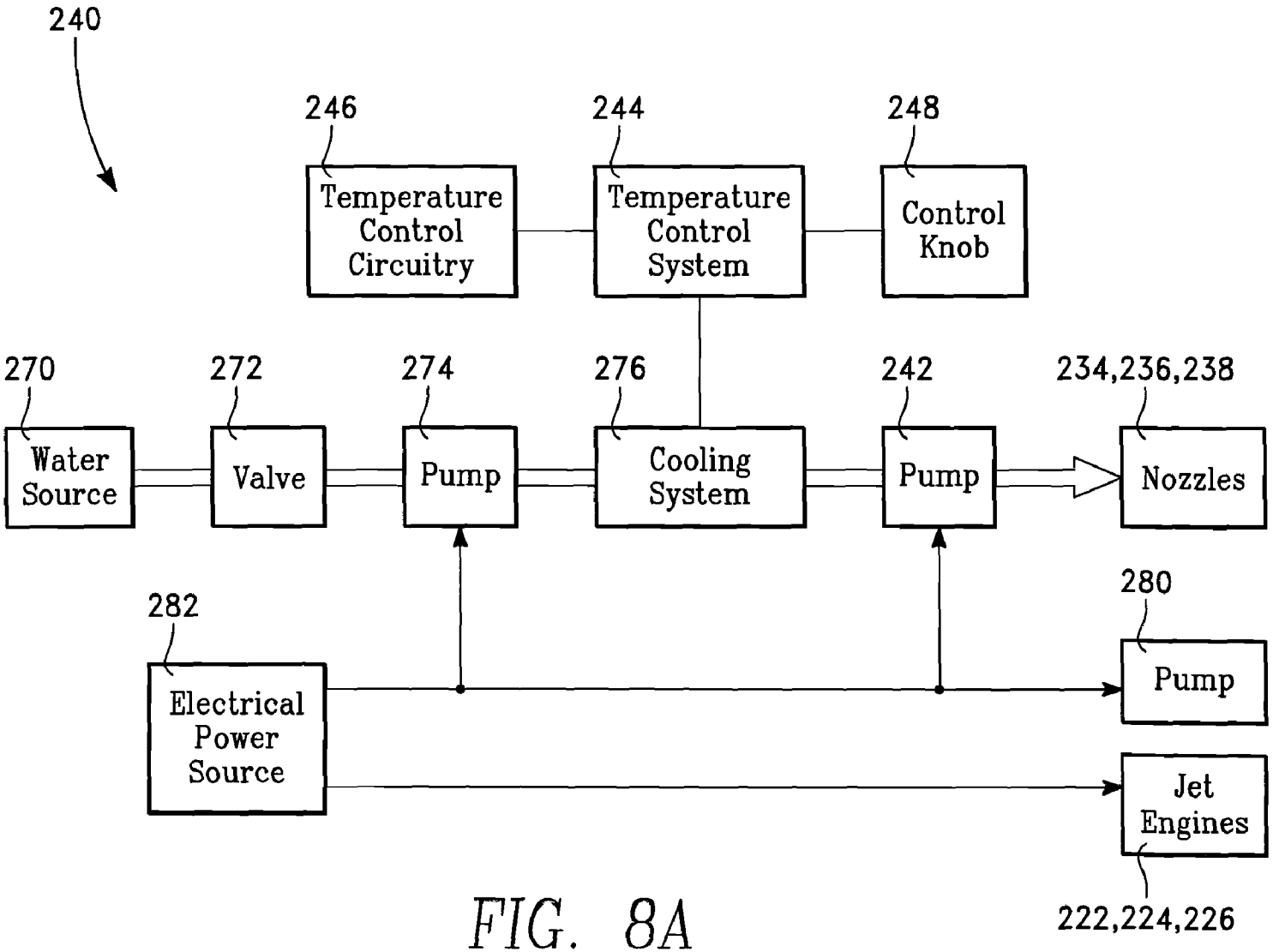
FIGS. 8A and 8B are a block diagram which illustrates another embodiment of a fire fighting system which utilizes jet engines and a temperature controlled liquid for fighting forest and brush fires.
Figure 8B:
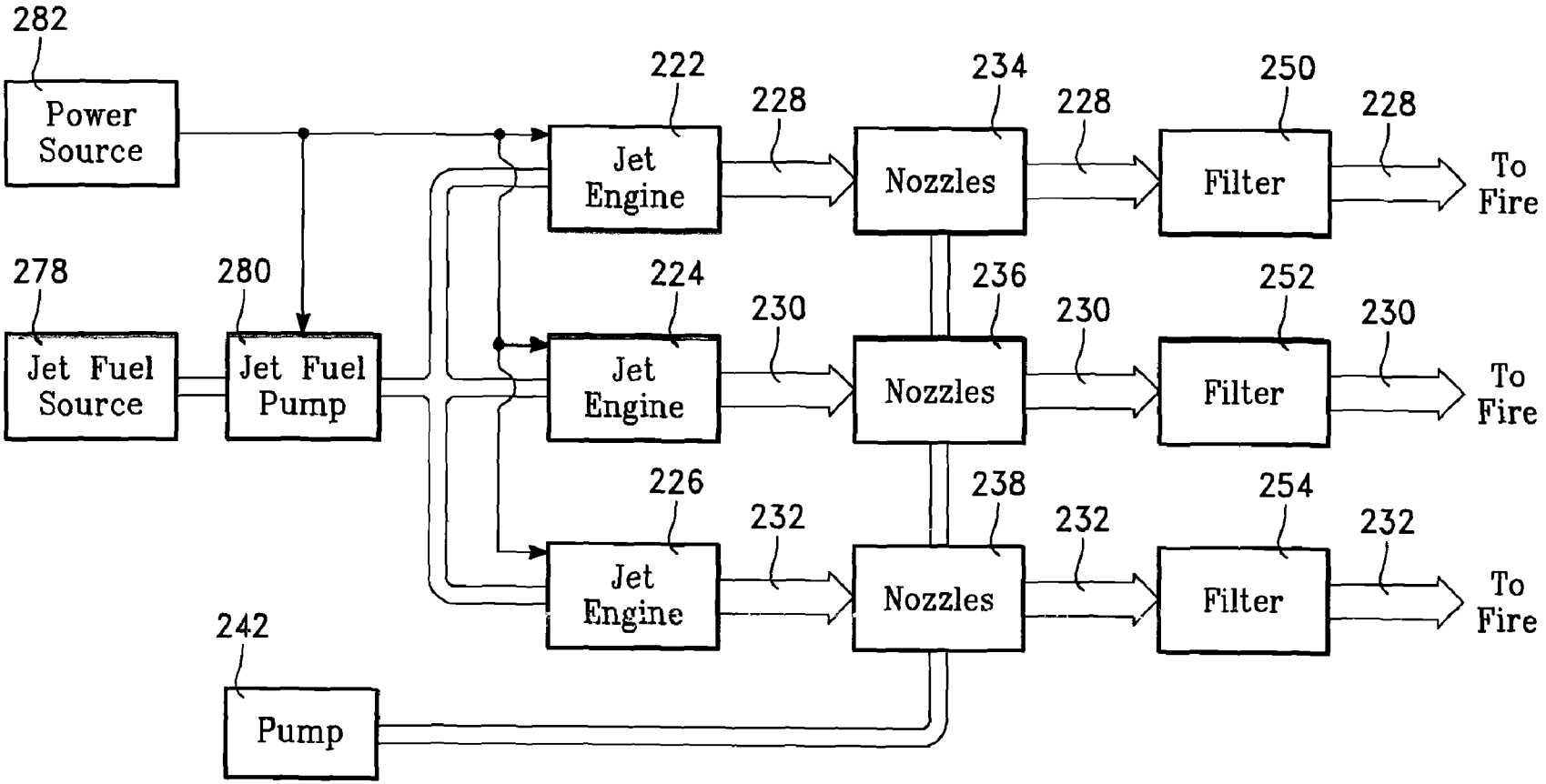

Referring now to FIGS. 8A and 8B, there is shown another embodiment of a fire fighting system 240 which is used in fighting forest and brush fires under hot, dry and windy conditions. The fire fighting system 240 of FIGS. 8A and 8B controls and extinguishes forest and brush fires under dry and windy conditions and comprises three jet engines 222, 224 and 226 positioned in proximity to the forest ad brush fire, with each of the jet engines 222, 224 and 226 generating a high velocity air stream for fighting the fires. Each jet engine 222, 224 and 226 generates an extremely high velocity air stream in the range of 100 to 400 mph.

A first pump 274 withdraws water from a reservoir/water source 270 at ambient temperatures. A normally closed valve 272 is positioned between the pump 274 and the water source 270. Valve 272 when opened allows pump 274 to transfer the water withdrawn from the reservoir 270 to a cooling system 276, which comprises a refrigeration unit.

Cooling system 276 is connected pump 274 for the purpose of receiving water withdrawn from said reservoir 270 and then cooling the water withdrawn from reservoir 270 to a temperature of forty to fifty degrees Fahrenheit. As shown in FIG. 8A, the cooling system 276 includes a temperature control knob 248 and temperature control circuitry 246 for adjusting and maintaining water temperature of the water withdrawn from the reservoir 270.

The fire fighting system 240 also includes nozzles 234, 236 and 238 with at least one of the nozzles 234, 236 and 238 being positioned in a path for the air stream generated by each of the jet engines 222, 224 and 226.

A second pump 242 connected to the cooling system 276 and each of the nozzles 234, 236 and 238 transfers pressurized cold water from the cooling system to each of the nozzles 234, 236 and 238. The cooling system 276 which may be a refrigeration unit insures that the temperature of the cold water is maintained at the desired temperature level of 40 to 50 degrees Fahrenheit. As shown in FIG. 8B, at least one nozzle 234, 236 or 238 is associated with each air stream 228, 230 or 232 injecting pressurized cold water into the path of air stream forming an air water mixture within the air stream 228, 230 or 232.

Referring to FIG. 8B, the fire fighting system 240 also includes filters 250, 252 and 254 with one of said filters 250, 252 or 254 being positioned in the path of the air stream 228, 230 or 232 generated by each of the jet engines 222, 224 or 226. Each of the filters 250, 252 and 254 generates fine particles of cold water within the air water mixture passing through the filter 250, 252 or 254. The fine particles of cold water within each of the air streams 228, 230 and 232 are projected into the atmosphere at the edge of the forest and brush fire dropping the temperature to forty to fifty degrees Fahrenheit at the edge of the forest and brush fire which creates a barrier against the forest and brush fire containing and then extinguishing the forest and brush fire.

A source of jet fuel 278 is included in the fire fighting system 240 for providing jet fuel to each of the jet engines 222, 224 and 226. A jet fuel pump 280 is connected to the source of jet fuel 278 and each of the jet engines 222, 224, and 226. The jet fuel pump 280 when activated transfers the jet fuel from the source of jet fuel 278 to the jet engines 222, 224 and 226. A source of electrical power 282 supplies electrical current to each of the jet engines 222, 224 and 226 to activate and to ignite the jet fuel to run the jet engines 222, 224 and 226. The source of electrical power 228 supplies electrical current to electric motors for each of the pumps 242, 274 and 280 to activate and run the electric motors for pumps 242, 274 and 280.

Referring to FIGS. 5, 8A and 8B, the pump motor 159 powers jet fuel pump 280, pump motor 175 powers pump 274 and pump motor 177 powers pump 242.

The pump motor 159 for pump 280 is activated by closing switch 162. This results in the fuel being transferred under pressure from jet fuel source 278 to each of the jet engines 222, 224 and 226.

Closing switch 102 opens normally closed valve 272 and activates pump motor 175. Activating pump motor 175 withdraws water from water source 270 under pressure which is supplied to cooling system 276. Closing push button 110 supplies electrical current to electrical control circuitry 145 which is a component of temperature control circuitry 246. Activation of electrical control circuitry 145 activates the cooling elements for cooling system 276 which reduces the temperature of the fire suppressant liquid/water from about 70 degrees Fahrenheit to about 40-50 degrees Fahrenheit.

When the temperature is at the desired temperature, normally open switch 104 closes which activates the pump motor 177 for pump 242. When pump 242 is activated the fire suppressant liquid is withdrawn from cooling system 276 and supplied to nozzles 234, 236 and 238.

A temperature meter 106 (FIG. 5) is provided for monitoring the water temperature within the cooling system 276 to insure that the temperature of the water injected into each of the air streams 228, 230 and 232 is within the temperature of forty to fifty degrees Fahrenheit.

A velocity meter 108 (FIG. 5) is provided for monitoring the velocity of the air streams 228, 230 and 232 generated by the jet engines 222, 224 and 226 to insure that the velocity is within said range of 100 to 400 mph.

A particle size for the fine particles of cold water provided by filters 250, 252 and 254 is from about one micron to about forty microns. Each of the filters 250, 252 and 254 comprises a screen mesh which produces the fine particles of cold water.

From the foregoing, it may readily be seen that the present invention comprises a new unique and exceedingly useful weather adjustment system for fighting fires which constitutes a considerable improvement over the known prior art. Obviously many modifications and variations of the present invention are possible in light of the above teachings. It is therefore to be understood that within the scope of the appended claims that the invention may be practiced otherwise than specifically described.

What is claimed is:

1. A fire fighting system for controlling and extinguishing a forest and brush fire under dry and windy conditions, comprising:

(a) a plurality of jet engines positioned in proximity to said forest and brush fire, each of said plurality of jet engines generating a high velocity air stream;

(b) a first pump for withdrawing water from a reservoir at ambient temperatures;

(c) a cooling system connected to said first pump for receiving the water withdrawn from said reservoir, said cooling system cooling the water withdrawn from said reservoir to a temperature of forty to fifty degrees Fahrenheit, wherein said cooling system includes a temperature control knob and temperature control circuitry for adjusting and maintaining water temperature of the water withdrawn from said reservoir;

(d) a plurality of nozzles, one of said plurality of nozzles being positioned in a path for the air stream generated by each of said jet engines;

(e) a second pump connected to said cooling system and each of said plurality of nozzles to transfer pressurized cold water from said cooling system to each of said plurality of nozzles;

(f) said one nozzle associated with each air stream injecting said pressurized cold water into the path of said air stream forming an air water mixture within said air stream;

(g) a plurality of filters, one of said filters being positioned in the path of said air stream generated by each of said jet engines, each of said filters generating fine particles of cold water within said air water mixture passing through said filter, wherein said fine particles of cold water within each of said air streams are projected into the atmosphere at the edge of said forest and brush fire dropping the temperature to forty to fifty degrees Fahrenheit at the edge of said forest and brush fire which creates a barrier against said forest and brush fire containing and then extinguishing said forest and brush fire;

(h) a source of fuel for providing jet fuel to each of said plurality of jet engines;

(i) a third pump connected to said source of fuel and each of said plurality of jet engines, said third pump when activated transferring said jet fuel from said source of fuel to said jet engines; and (j) a source of electrical power for supplying electrical current to each of said plurality of jet engines to activate and to ignite said jet fuel to run said jet engines; and (k) said source of electrical power supplying said electrical current to electric motors for each of said first, second and third pumps to activate and run the electric motors for said first, second and third pumps.

2. The fire fighting system of claim 1 further comprising a temperature meter for monitoring the water temperature within said cooling system to insure that the temperature of the water injected into each of said air streams is within said temperature of forty to fifty degrees Fahrenheit.

3. The fire fighting system of claim 1 further comprising a velocity meter for monitoring the velocity of said air streams generated by said plurality of jet engines to insure that the velocity is within said range of 100 to 400 mph.

4. The fire fighting system of claim 1 wherein a particle size for said fine particles of cold water is from about one micron to about forty microns.

5. The fire fighting system of claim 4 wherein each of said filters comprises a screen mesh for providing said fine particles of cold water from about one micron to about forty microns.

6. The fire fighting system of claim 1 wherein said cooling system comprises a refrigeration unit which cools and maintains the water from said reservoir at said temperature of forty to fifty degrees Fahrenheit.

7. The fire fighting system of claim 1 further comprising a normally closed valve having an inlet port connected to said reservoir and an outlet port connected to said first pump, said normally closed valve when opened allowing said first pump to transfer the water withdrawn from said reservoir to said cooling system.

8. The fire fighting system of claim 1 wherein said source of electricity comprises a diesel powered generator, an electrical transmission line or a solar powered battery source.

9. A fire fighting system for controlling and extinguishing a forest and brush fire under dry and windy conditions, comprising:

(a) first, second and third jet engines positioned in proximity to said forest ad brush fire, each of said first, second and third jet engines generating a high velocity air stream;

(b) a first pump for withdrawing water from a reservoir at ambient temperatures;

(c) a cooling system connected to said first pump for receiving the water withdrawn from said reservoir, said cooling system cooling the water withdrawn from said reservoir to a temperature of forty to fifty degrees Fahrenheit, wherein said cooling system includes a temperature control knob and temperature control circuitry for adjusting and maintaining water temperature of the water withdrawn from said reservoir;

(d) first, second and third nozzles, one of said first, second and third nozzles being positioned in a path for the air stream generated by each of said first, second and third jet engines;

(e) a second pump connected to said cooling system and each of said first, second and third nozzles to transfer pressurized cold water from said cooling system to each of said first, second and third nozzles;

(f) said one nozzle associated with each air stream injecting said pressurized cold water into the path of said air stream forming an air water mixture within said air stream;

(g) first, second and third filters, one of said filters being positioned in the path of said air stream generated by each of said jet engines, each of said first, second and third filters generating fine particles of cold water within said air water mixture passing through said filter, wherein said fine particles of cold water within each of said air streams are projected into the atmosphere at the edge of said forest and brush fire dropping the temperature to forty to fifty degrees Fahrenheit at the edge of said forest and brush fire which creates a barrier against said forest and brush fire containing and then extinguishing said forest and brush fire;

(h) a source of fuel for providing jet fuel to each of said first, second and third jet engines;

(i) a third pump connected to said source of fuel and each of said first, second and third jet engines, said third pump when activated transferring said jet fuel from said source of fuel to said each of said first, second and third jet engines; and (j) a source of electrical power connected to said first, second and third jet engines for supplying electrical current to each of said first, second and third jet engines to activate and to ignite said jet fuel to run said first, second and third jet engines; and (k) said source of electrical power being connected to electric motors for said first, second and third pumps, wherein said source of electrical power supplies said electrical current to the electric motors for each of said first, second and third pumps to activate and run the electric motors for said first, second and third pumps.

10. The fire fighting system of claim 9 further comprising a temperature meter for monitoring the water temperature within said cooling system to insure that the temperature of the water injected into each of said air streams is within said temperature of forty to fifty degrees Fahrenheit.

11. The fire fighting system of claim 9 further comprising a velocity meter for monitoring the velocity of said air streams generated by said first, second and third jet engines to insure that the velocity is within said range of 100 to 400 mph.

12. The fire fighting system of claim 9 wherein a particle size for said fine particles of cold water is from about one micron to about forty microns.

13. The fire fighting system of claim 12 wherein each of said first, second and third filters comprises a screen mesh for providing said fine particles of cold water from about one micron to about forty microns.

14. The fire fighting system of claim 9 wherein said cooling system comprises a refrigeration unit at said temperature of forty to fifty degrees Fahrenheit.

15. The fire fighting system of claim 9 further comprising a normally closed valve having an inlet port connected to said reservoir and an outlet port connected to said first pump, said normally closed valve when opened allowing said first pump to transfer the water withdrawn from said reservoir to said cooling system.

16. The fire fighting system of claim 9 wherein said source of electricity comprises a diesel powered generator, an electrical transmission line or a solar powered battery source.

17. A fire fighting system for controlling and extinguishing a forest and brush fire under dry and windy conditions, comprising:

(a) first, second and third jet engines positioned in proximity to said forest ad brush fire, each of said first, second and third jet engines generating a high velocity air stream;

(b) a first pump for withdrawing water from a reservoir at ambient temperatures;

(c) a cooling system connected to said first pump for receiving the water withdrawn from said reservoir, said cooling system cooling the water withdrawn from said reservoir to a temperature of forty to fifty degrees Fahrenheit, wherein said cooling system includes a temperature control knob and temperature control circuitry for adjusting and maintaining water temperature of the water withdrawn from said reservoir;

(d) first, second and third nozzles, one of said first, second and third nozzles being positioned in a path for the air stream generated by each of said first, second and third jet engines;

(e) a second pump connected to said cooling system and each of said first, second and third nozzles to transfer pressurized cold water from said cooling system to each of said first, second and third nozzles;

(f) said one nozzle associated with each air stream injecting said pressurized cold water into the path of said air stream forming an air water mixture within said air stream;

(g) first, second and third filters, one of said filters being positioned in the path of said air stream generated by each of said jet engines, each of said first, second and third filters generating fine particles of cold water within said air water mixture passing through said filter, wherein said fine particles of cold water within each of said air streams are projected into the atmosphere at the edge of said forest and brush fire dropping the temperature to forty to fifty degrees Fahrenheit at the edge of said forest and brush fire which creates a barrier against said forest and brush fire containing and then extinguishing said forest and brush fire;

(h) a source of fuel for providing jet fuel to each of said first, second and third jet engines;

(i) a third pump connected to said source of fuel and each of said first, second and third jet engines, said third pump when activated transferring said jet fuel from said source of fuel to said each of said first, second and third jet engines; and (j) a source of electrical power connected to said first, second and third jet engines for supplying electrical current to each of said first, second and third jet engines to activate and to ignite said jet fuel to run said first, second and third jet engines;

(k) said source of electrical power being connected to electric motors for said first, second and third pumps, wherein said source of electrical power supplies said electrical current to the electric motors for each of said first, second and third pumps to activate and run the electric motors for said first, second and third pumps;

(l) a normally closed valve having an inlet port connected to said reservoir and an outlet port connected to said first pump, said normally closed valve when opened allowing said first pump to transfer the water withdrawn from said reservoir to said cooling system;

(m) a temperature meter for monitoring the water temperature within said cooling system to insure that the temperature of the water injected into each of said air streams is within said temperature of forty to fifty degrees Fahrenheit; and (n) a velocity meter for monitoring the velocity of said air streams generated by said first, second and third jet engines to insure that the velocity is within said range of 100 to 400 mph.

18. The fire fighting system of claim 17 wherein each of said first, second and third filters comprises a screen mesh for providing said fine particles of cold water which are from about one micron to about forty microns in size.

19. The fire fighting system of claim 17 wherein said cooling system comprises a refrigeration unit at said temperature of forty to fifty degrees Fahrenheit.

20. The fire fighting system of claim 17 wherein said source of electricity comprises a diesel powered generator, an electrical transmission line or a solar powered battery source.

* * * * *